US005366296A

United States Patent [19]

Stenstrom et al.

[11] Patent Number: 5,366,296

[45] Date of Patent: Nov. 22, 1994

[54] DISCHARGING DEVICE FOR A PACKAGING CONTAINER

[75] Inventors: Lennart A. Stenstrom, Trosa; Lennart S. Wahlstrom, Saltsjobeden; Bert S. Wikholm, Tullinge, all of Sweden

[73] Assignee: AB Tetra Pak, Sweden

[21] Appl. No.: 75,224

[22] Filed: Jun. 10, 1993

Related U.S. Application Data

[60] Division of Ser. No. 967,555, Oct. 27, 1992, Pat. No. 5,251,982, which is a continuation of Ser. No. 623,800, Mar. 6, 1991, abandoned.

[30] Foreign Application Priority Data

Jul. 8, 1988 [SE] Sweden ..... 8802557

[51] Int. Cl.[5] ..... B65D 33/36

[52] U.S. Cl. ..... 383/210; 383/906

[58] Field of Search ..... 383/210, 211, 906

[56] References Cited

U.S. PATENT DOCUMENTS

| | | | |
|---|---|---|---|
| 3,051,368 | 8/1962 | Schneider et al. | 383/210 X |
| 3,342,326 | 9/1967 | Zackheim | 383/210 X |
| 3,651,615 | 3/1972 | Bohner et al. | 383/210 X |
| 3,740,237 | 6/1973 | Grindrod et al. | 383/211 X |
| 3,791,570 | 2/1974 | Hopkins | 383/210 |
| 3,917,116 | 11/1975 | Mason | 383/211 X |
| 4,131,200 | 12/1978 | Rinfret | 383/210 X |
| 4,183,434 | 1/1980 | Watt | 383/210 X |
| 4,234,026 | 11/1980 | Bayham | 383/210 X |
| 4,871,091 | 10/1989 | Prezlosi | 383/210 X |

*Primary Examiner*—Allan N. Shoap
*Assistant Examiner*—Jes F. Pascua
*Attorney, Agent, or Firm*—Lerner, David, Littenberg, Krumholz & Mentlik

[57] ABSTRACT

A packaging container having a discharging or docketing device for allowing uninterrupted aseptic connection to for instance a hose having an orifice.

The container has a channel (13') of a flexible material terminated by a grip flap (16). The flap (16) is torn away along tearing denotations (17, 17') and weakenings (19, 20) for opening the channel. By locating the weakenings (16) such that they do not coincide, there is obtained at least one protruding portion which will expose a portion on the inside of the channel when the channel is opened up.

This portion then acts as an entering surface for facilitating connection.

2 Claims, 4 Drawing Sheets

DISCHARGING DEVICE FOR A PACKAGING CONTAINER

CROSS-REFERENCE TO RELATED APPLICATIONS

This application is a divisional of U.S. Ser. No. 07/967,555, filed Oct. 27, 1992, now U.S. Pat. No. 5,251,982, which is a continuation of U.S. Ser. No. 07/623,800, filed Mar. 6, 1991, now abandoned.

Field of the invention:

The present invention relates to a discharging device for a packaging container and more precisely to a discharging device of the docking type. The connection or docking of a packaging container to for instance a hose having an orifice frequently represents a need. Within the medical care, there are consumed a huge amount of pouches of flexible material for nutrition solutions of different types and there is a need for handling such packages in a more rational manner.

Besides, there is a high degree of aseptics necessary when parental nutrition solutions are involved, for instance infusion solutions, etc.

PRIOR ART AND BACKGROUND OF THE INVENTION

The prior art within the field of discharging devices for flexible pouches comprises pouches having specific orifices welded to the poach before filling and sealing, said orifices having tearable closures or needles or other puncturing tools for penetrating a membrane of the closure.

The prior art discharging or docking devices do meet reasonable hygiene and aseptic standards but from a production point of view the known constructions imply higher cost due to an irrational manufacturing procedure needing for instance separate welding of orifice details.

Previously, pouches of the actual type have been manufactured in the traditional manner, i.e. pouches have been manufactured individually from blanks.

The use of a "hose" techniques for manufacturing pouches having an aseptic contents is for instance enclosed in Swedish Patent No. 455 044. Such techniques, however, makes use of a separate connector men%her for docking to the interior of the pouch.

OBJECTS OF THE INVENTION

The object of the present invention is to provide a packaging container having an integral docking device or discharging device, for instance formed directly from a hose forming procedure, and allowing an aseptic type of docking or assembling to a discharge conduit. The docking device according to the present invention may, with advantage, be used in an application where a product containing package is formed from a filled hose, but of course there are other fields of application.

SUMMARY OF THE INVENTION

Thus, the invention provides a packaging container having a channel formed of a flexible material intended for connecting the interior of the container to a discharging device, for instance a hose having an orifice.

The container is characterized in that the channel is terminated by a grip flap for opening the channel, and the grip flap is such that it exposes a portion of the inside of the channel when opening up the channel.

In a preferred embodiment there is arranged a denotation for initially tearing off the grip flap at the edge region of the channel, said tearing denotation joining a circumferential weakening line cross-wise the channel, and the circumferential denotation defining at least a section projecting from the opened up channel and acting as an entering surface for the discharging device.

In a specific embodiment the channel is terminated by a weakened welding portion and free grip flaps are arranged outside said welded portion.

In still another embodiment, the grip flap is arranged as a termination of a tearable end portion of a channel having a curved cross-section.

DESCRIPTION OF PREFERRED EMBODIMENTS

Figure 1:
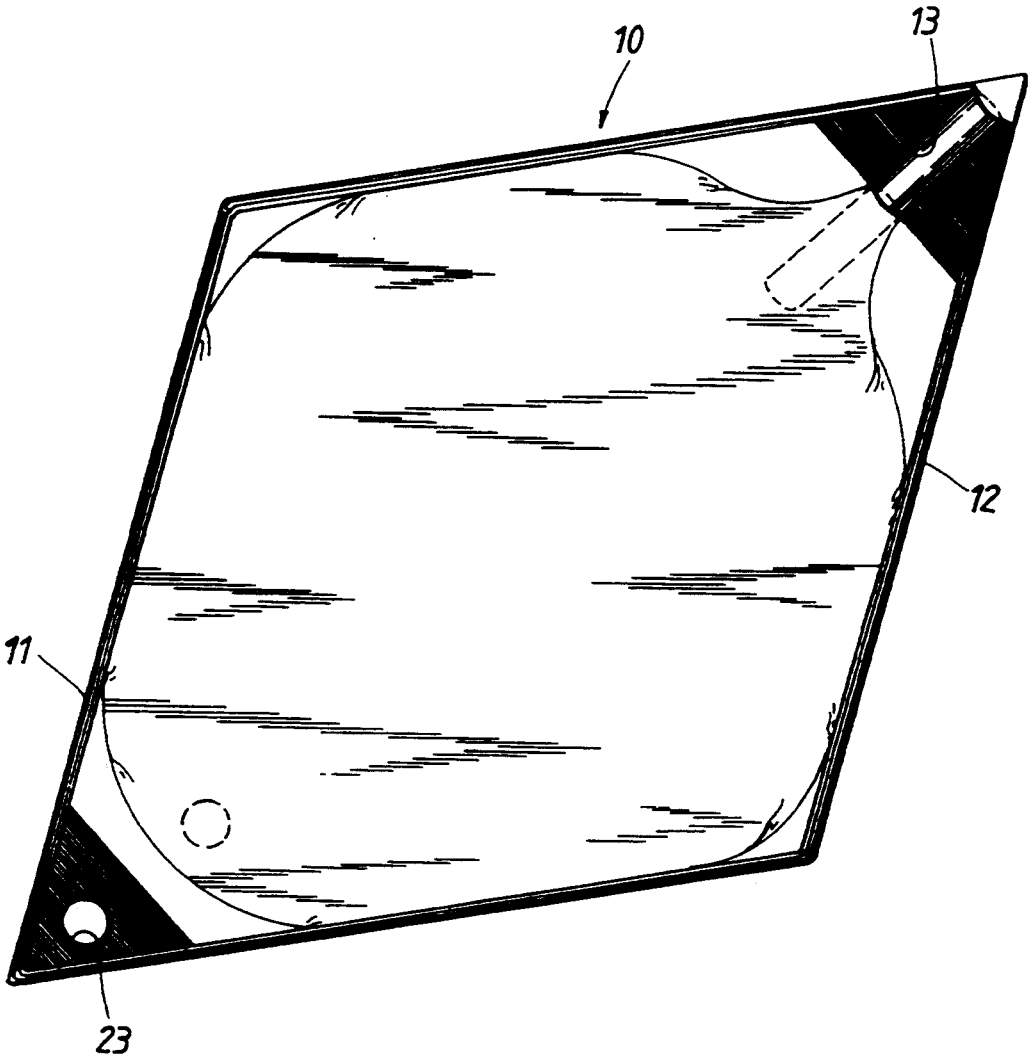
FIG. 1 shows a certain type of flexible pouch having a tearing arrangement according to the invention.

The pouch 10 in FIG. 1 is a two-sided, alternatively three-sided welded pouch. In the first case, there are lateral welds 11, 12 obtained by folding one single planar blank of a flexible plastics or laminate material to the shape in FIG. 1 or by flattening a hose along the regions of the lateral welds 11, 12. In the latter case, the welds 11, 12 preferably are made in a hose filled by a product, meaning that said product, in a manner now per se, is pressed away from the locations for the welds before such welds are made.

At the same time as the welds are made, welds are also made for forming a channel 13 at the corner region of the rhomboidic, filled pouch 10 in FIG. 1. Additionally, a weld is made at a diagonally opposite corner for forming a suspension hole 23.

Figure 2:
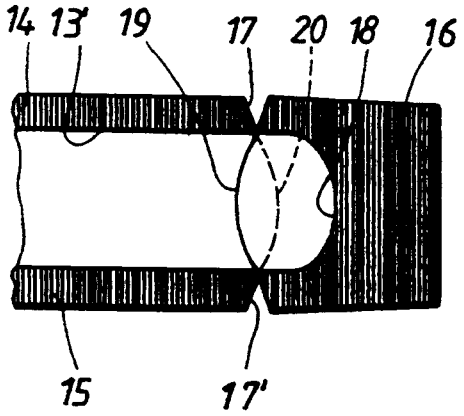
FIG. 2 is a partial view of a first embodiment of a channel having a grip flap.
Figure 3:
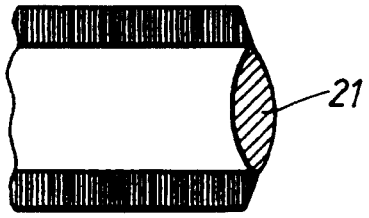
FIG. 3 shows the channel in FIG. 2 exposed after the removal of the grip flap.

In FIG. 2 there is shown in a partial view, in a first embodiment a channel 13', defining two parallel welds 14, 15 and terminated by a grip flap 16. A pair of denotations 17, 17' for initial tearing off the grip flap are arranged in a respective one of the welds 14, 15. The channel 13', which in the actual case may be formed by two plastics toils, laminates or webs, is terminated in an unopened condition along the curved line 18 in FIG. 2. Outside such line the grip flap is welded as indicated by the hatched areas. In the upper web in FIG. 2 forming the channel 13' there is a first curved weakening 19, and in the lower web in FIG. 2 there is a second curved weakening 20 shown hatched. As appears from FIG. 2 and as more precisely shown in FIG. 3, there will be obtained a docking or entering portion 21 of the channel after tearing off the grip flap along the weakenings 19, 20. This portion 21 exposes part of the inside of the channel directly after tearing and allows a quick insertion of the orifice of the discharge device. The aseptics will be interrupted only shortly and the contents of the inner packaging container will not be disturbed at all by an entering or docking operation.

Figure 4:
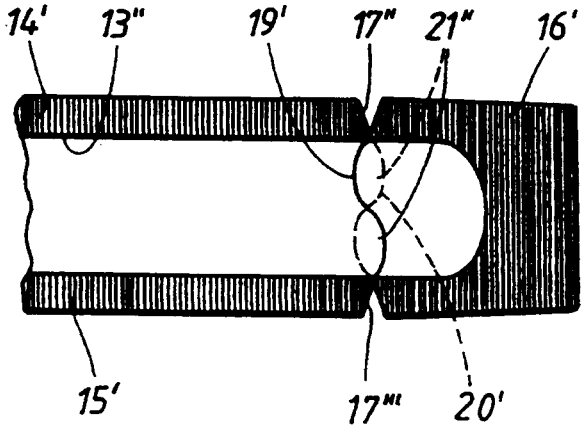
FIG. 4 shows another embodiment of a channel having a grip flap.

In FIG. 4 it is shown how there is obtained more than one entering surface. Also here, the channel 13'' is terminated by a grip 16'. In welds 14', 15' there are initial denotations 17'', 17''' and in the upper foil web there is a S-shaped weakening 19', and in a corresponding manner as in FIG. 2, there is weakening 20', in this case S-shaped in the lower foil web.

Figure 5:
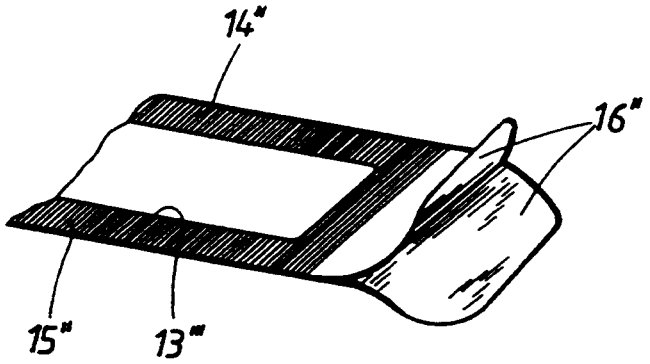
FIG. 5 shows still one more embodiment of a channel and a grip flap.
Figure 6:
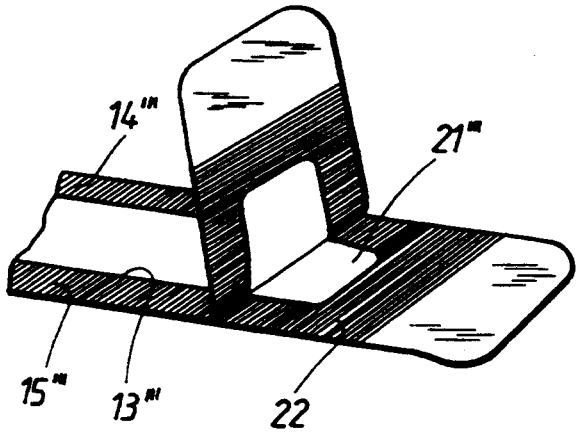
FIG. 6 shows the channel in FIG. 5 opened up.

In FIG. 5 the grip has a pair of free flaps 16''. The channel 13''' is defined by two parallel welds 14'', 15'', and is terminated by a weakened transverse weld 22. This weld 22 may be formed as a so called peelable weld by means of prior art techniques. The entering surface obtained for the aseptic docking has been denoted 21''' in FIG. 6.

Figure 7:
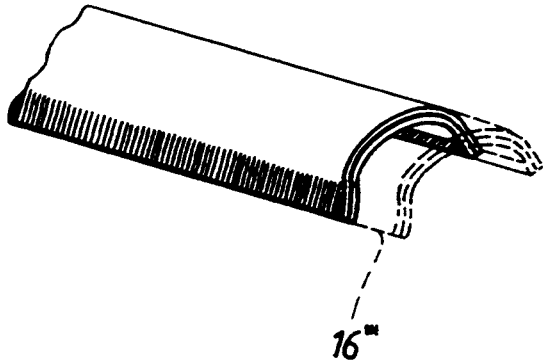
FIG. 7 shows one version of a channel having an accompanying grip.
Figure 8:
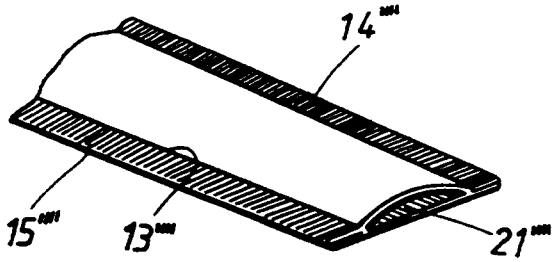
FIG. 8 shows the channel in FIG. 7 opened up and exposed.

In FIG. 7, 8 there is a channel 13'''' defined by two parallel welds 14'''', 15'''' The two foils which form a channel in FIG. 7, 8 have been welded together as appears from FIG. 7, i.e. having a curved cross section, contrary to the prior "planar" cross-section. The grip portion 16''' in FIG. 7 is removed by means of tearing denotations and weakenings and as a result the configuration according to FIG. 8 is obtained. The entering surface has been denoted 21''''.

Although a few embodiments of the invention have been described, it is realized that modifications and alternatives are possible within the scope of the inventive idea. For instance, which is common, the channels 13—13'' may be formed with decreasing cross-section in a direction towards the interior of the packaging container. Instead of having a flexible pouch 10 having an integral channel, it is possible to form separate channel units for mounting to containers of different kinds. However, the integral manufacturing procedure according to the present embodiments is preferable in the present context.

We claim:

1. A packaging container comprising reservoir means for storing a dispensable material and dispensing means for dispensing the material from said reservoir, said dispensing means comprising first and second superimposed flexible panels non-peelably sealed together along a pair of spaced parallel edges to define a hollow channel therebetween and extending from said reservoir means to a predetermined termination point, said first and second superimposed panels extending beyond said predetermined termination point to define first and second grip means, said predetermined termination point of said hollow channel being defined by a peelable seal displaced inwardly from said first and second grip means and extending between said spaced edges, whereby said hollow channel may be opened by exerting a sufficient force upon said first and second grip means to open said peelable seal.

2. A packaging container according to claim 1, wherein said hollow channel has a substantially constant cross-section.

* * * * *

UNITED STATES PATENT AND TRADEMARK OFFICE

CERTIFICATE OF CORRECTION

PATENT NO. : 5,366,296

DATED : November 22, 1994

INVENTOR(S) : Stenstrom

It is certified that error appears in the above-indentified patent and that said Letters Patent is hereby corrected as shown below:

On the title page, insert the following: --PCT/SE89/00394 filed July 6, 1989--

Column 1, line 46, "men%her" should read --member--.

Column 2, line 8, "embodiment the" should read --embodiment, the--.

Signed and Sealed this

Thirty-first Day of January, 1995

Bruce Lehman

*Attest:*

BRUCE LEHMAN

*Attesting Officer*

*Commissioner of Patents and Trademarks*